United States Patent [19]

Baggio et al.

[11] Patent Number: 4,910,881

[45] Date of Patent: Mar. 27, 1990

[54] HEATING DEVICE FOR FOOTWEAR, PARTICULARLY FOR SKI BOOTS

[75] Inventors: Giorgio Baggio, San Martino di Lupari; Adolfo Pozzebon, Sala d'Istrana, both of Italy

[73] Assignee: Nordica S.p.A., Montebelluna TV, Italy

[21] Appl. No.: 261,440

[22] Filed: Oct. 24, 1988

[30] Foreign Application Priority Data

Nov. 3, 1987 [IT] Italy ..... 82598 A/87

[51] Int. Cl.[4] ..... A43B 7/02; A43B 5/04

[52] U.S. Cl. ..... 36/2.6; 36/117; 219/211

[58] Field of Search ..... 36/2.6, 117-121; 219/211, 527

[56] References Cited

U.S. PATENT DOCUMENTS

| | | | |
|---|---|---|---|
| 4,280,286 | 7/1981 | Sartor | 36/118 |
| 4,507,877 | 4/1985 | Vaccari et al. | 36/2.6 |
| 4,724,626 | 2/1988 | Baggio et al. | 36/117 |
| 4,782,602 | 11/1988 | Lakic | 36/2.6 |
| 4,798,933 | 1/1989 | Annovi | 219/211 |
| 4,800,659 | 1/1989 | Marega | 36/119 |
| 4,823,482 | 4/1989 | Lakic | 36/2.6 |

FOREIGN PATENT DOCUMENTS

| | | | |
|---|---|---|---|
| 0205110 | 12/1986 | European Pat. Off. | 36/2.6 |

*Primary Examiner*—James Kee Chi

*Attorney, Agent, or Firm*—Guido Modiano; Albert Josif

[57] ABSTRACT

A heating device for ski boots comprising an insole, provided with an electric resistor and temporarily associable with the boot, below which there is rigidly associated a rigid inner sole having, preferably at the heel region, an accommodation for one or more accumulators. Electric conductors are furthermore provided which extend from the insole and are connected to a support, provided with at least one switch, temporarily associable with one of the components of the ski boot.

20 Claims, 1 Drawing Sheet

HEATING DEVICE FOR FOOTWEAR, PARTICULARLY FOR SKI BOOTS

BACKGROUND OF THE INVENTION

The present invention relates to a heating device for footwear, particularly for ski boots.

Various heating devices are currently known, applicable to footwear in general and usually consituted by an insole insertable within the upper and provided, either internally or on one of its surfaces, with an electric resistor connectable to a power source.

The power source is usually placed externally to the boot, since it is bulky and requires switches accessible to the user for the delivery of power at the required moment.

It is thus known to use as power source a battery of accumulators arrangeable externally to the boot.

It is also known to locate the electric resistor at a sock which can be worn by the skier.

All said known types of devices have, however, some disadvantages; in case of stress, in fact, the accumulators may detach from their support, severing the wires.

Furthermore, the wires are located externally to the boot, and may get accidentally caught and thus be cut.

As a partial solution to these disadvantages, a boot has been disclosed in which the accumulators are arranged within a suitable cavity provided within the heel and power a resistor located within an inner sole.

This type of device, however, also has some disadvantages: it is in fact necessary to provide a particular structure for the inner shoe, the power source and the resistor being furthemore difficult to access for any maintenance.

A partial solution to these disadvantages is disclosed in U.S. Pat. No. 4,507,877, filed Jan. 10, 1983 by this applicant, in which a heating device comprises an electric resistor located on the inner shoe of a ski boot, at the foot of the user, and electrically connected to at least one electric accumulator accommodated in a seat defined in said inner shoe.

This heating device is not free from disadvantages: it is in fact necessary to provide an inner shoe of a particular type, downwardly provided with a rigid foot resting surface, requiring therefor the provision of a complementarily shaped seat at the wedge of the shell.

The particular structure of the inner shoe, furthermore, does not allow its interchangeability within the various models of a line of boots.

Another disadvantage resides in the fact that if it is necessary to check the operation of the various electric components it is impossible for the skier to use the boot, since the inner shoe must be removed.

Ski boots are also known having, at the rear and/or front quarter, a suitable seat for a removable battery of accumulators.

However, even this type of solution has the disadvantage of having to design the front or rear quarter of the boot with a special structure adapted to accommodate said container, thus increasing production costs and furthermore requiring more stringent testing, once the boot is assembled, to verify the correct operation of the components.

U.S. Pat. No. 3,906,185, discloses an insole provided with an electric resistor and adapted to be fitted into a shoe or boot. The resistor is powered by a power pack containing rechargeble batteries and adapted to be carried by the user, for example at the belt.

Although the heated insole is easily adaptable to different shoe sizes, the external battery pack is clearly an inconvenience especially for sports use.

SUMMARY OF THE INVENTION

The main aim of the present invention is to eliminate the disadvantages described above in known types, by providing a heating device which can be used in footwear, and in particular in ski boots, not specifically conceived for the provision of internal heating.

Within the above described aim, another important object is to provide an easily and rapidly replaceable heating device, for example for maintenance.

Still another object is to provide a heating device having extreme flexibility and simplicity from the point of view of production especially because it is easily assembled to the boot and because its components can be tested easily.

Still another object is to provide a heating device which associates with the preceding characteristics that of having limited constraints from the point of view of the design of the boot.

Not least object is to provide a device which does not prevent use of boot even if the device has to be removed for maintenance.

This aim, the objects mentioned and others which will become apparent hereinafter are achieved by a heating device, particularly for ski boots having at least one quarter pivoted to a shell and of an inner shoe, characterized in that it comprises an insole provided with an electric resistor and associable with said boot, an inner sole being downwardly associated with said insole, said inner sole having a chamber for a power source and conductors connecting said power source with said resistor and with a control unit, said control unit having at least one switch, said insole being arrangeable within said inner shoe, said inner shoe having a seat shaped complementarily with respect to said chamber.

Advantageously, the insole has a flap for protecting the wires and for a better grip for extracting the insole from the shell.

Conveniently, the control unit is removably associated with the flap and protrudes from said rear quarter through an adapted opening.

BRIEF DESCRIPTION OF THE DRAWINGS

Further characteristics and advantages of the invention will become apparent from the detailed description of two particular but not exclusive embodiments, illustrated only by way of non-limitative example in the accompanying drawings, wherein.

DESCRIPTION OF THE PREFERRED EMBODIMENTS

Figure 2:
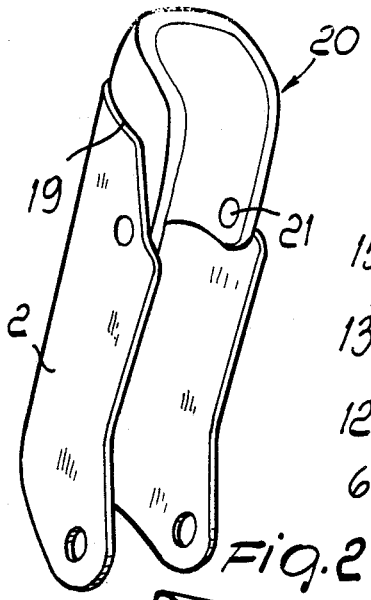
FIG. 2 is a perspective view, similar to the previous one of the rear quarter having a removable padded border.
Figure 1:
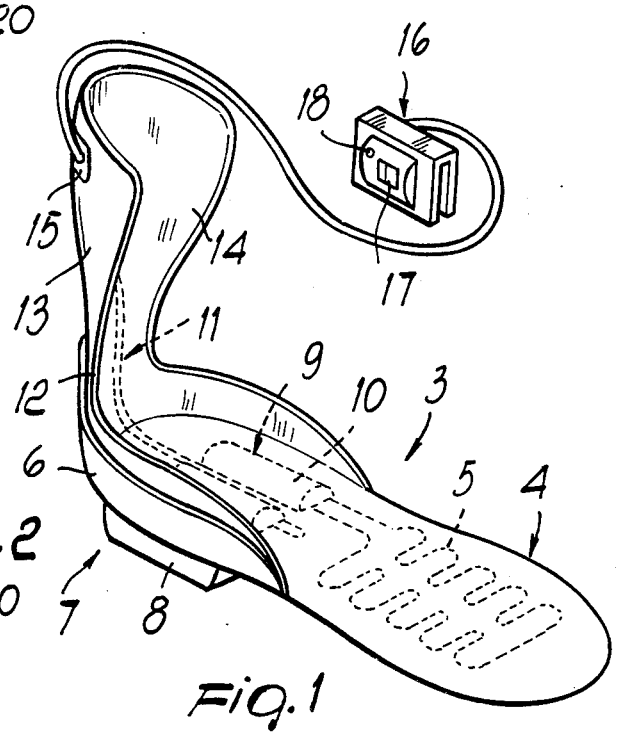
FIG. 1 is a perspective view of the insole.
Figure 3:
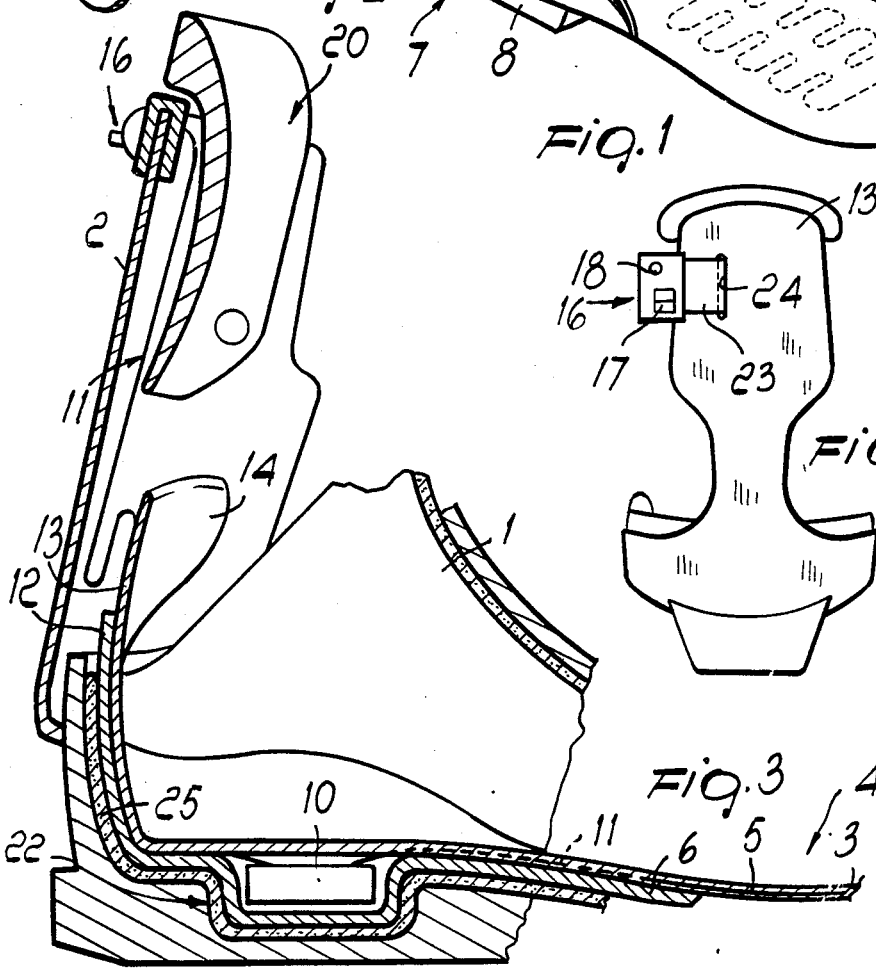
FIG. 3 is an elevated side view, sectioned along a longitudinal middle plane of the device, inserted within a ski boot.
Figure 4:
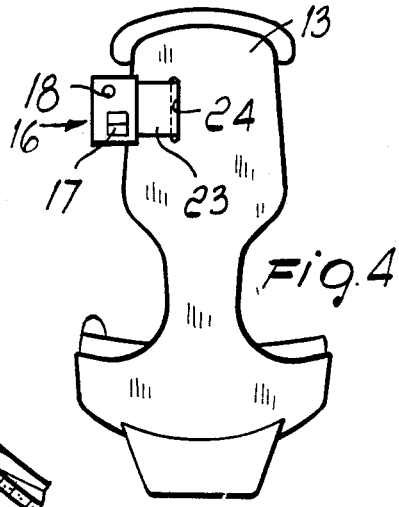
FIG. 4 is a rear view of an insole showing the switch removably associable at the flap.

With reference to the above described figures, in a ski boot composed of a rear quarter 2 pivoted to a shell 1 the heating device, according to the invention, comprises an insole 3 having an electric resistor 5, at the region 4 of the tip of the foot.

A rigid inner sole 6 is associated downwardly with respect to said insole 3 and has a protrusion 8 at the heel region 7. The protrusion 8 innerly defines an accommodation, or chamber 9, for one or more accumulators 10 constituting the power source.

The accumulators 10 are connected to the resistor 5 by means of adapted conductors 11 which are advantageously interposed between the rigid inner sole 6 and the insole 3.

Advantageously, the rigid inner sole 6 is rearwardly provided with a tab 12, arranged approximately perpendicular to the insole 3; a flap 13 is rigidly associated to the insole 3 and partially embraces the rear region of the foot of the skier.

Alternately, the flap 13 may be provided monolithically with the rigid inner sole 6 or be connected to the insole 3.

Said flap 13 advantageously has a padding 14, the conductors 11 extending between the latter and the flap.

Said conductors extend from the flap 13 through an adapted opening 15, and are connected at the other end to a control unit 16, provided with a switch 17 and a luminous indicator 18. The structure of unit 16 has a U-shaped configuration and is therefore temporarily associable with the boot, for example at the upper perimetral edge 19 of the rear quarter 2.

To prevent unit 16 from disconnecting accidentally, the rear quarter 2 has a padded edge 20 removably associable at the upper end of the rear quarter 2, for example by means of press-studs 21.

Unit 16 is thus easily placed with a certain portion of the conductors 11 between the inner surface of the rear quarter 2 and the border 20, so as to secure the unit 16 in said position.

A complementarily shaped seat or cavity 22 is furthermore provided on the sole of the inner shoe 25, at the protrusion 8 of the insole 3. The shaped cavity is the only modification to be performed to said inner shoe.

The region of the boot 1 affected by the cavity 22 is conveniently designed so as to be able to accommodate the cavity.

The use of the invention is therefore as follows: once the cavity 22 has been provided on the shell, and once the inner shoe 25 has been inserted, it is sufficient to insert the insole, complete with the heating system, inside the same.

Subsequently, after removing the rear border 20 from the rear quarter 2, the support 16 may be simply inserted at the upper perimetral edge 19 of said rear quarter, thus rendering accessible to the skier the switch 17 to allow the activation of the resistor 5; once the operation has been performed, the border 20 is recoupled to the rear quarter 2 by means of the simple pressure on the press-stud 21.

It has thus been observed that the invention achieves the intended aim and objects, a heating device having been obtained which is completely interchangeable and usable on a plurality of models simply by replacing the ordinary inner sole, lying below the inner shoe, with an inner sole having a seat 22 shaped complementarily with respect to the seat 8 of the insole 3.

Furthermore, in the case of maintenance operations, it is sufficient to replace or remove only the insole 3 which contains all the components of the heating device.

None of said components is in fact rigidly fixed to the boot.

Furthermore, the flap 13 allows to easily extract the entire heating device.

Naturally, the accumulators 10 may be recharged once the insole 3 is removed from the boot, or on the boot itself, the unit 16 advantageously having adapted means for recharging said accumulators.

It is furthermore stressed that the device has an extreme flexibility and simplicity from the point of view of production since the various components of the heating device may be preassembled in the insole and tested by the spcialized manufacturer.

Furthermore, it is possible to use the boot even without the heating device, the insole with heating system being replaceable with an ordinary insole.

Moreover the device's compactness poses very few limits to the design.

Naturally, the invention thus conceived is susceptible to numerous modifications and variations, all of which are within the scope of the same inventive concept.

For example, according to a further aspect of the invention, the unit 16 carrying the switch 17 and the luminous indicator 18 may be constituted by a box-like body laterally provided with a tab 23 removably associable rearwardly with respect to the flap 13, the same being inserted within an adapted opening 24 provided longitudinally to said flap.

An adapted opening is furthermore provided on the rear quarter, at the unit, to allow the skier access to the switch. Naturally, the device may be applied, as well as to rear-entry boots, also to front-entryboots, the conductors being interposed, proximate to the upper edge of the boot, between the inner shoe and the outer rigid containment body.

Naturally the materials and the dimensions constituting the individual components of the device may be the most suitable according to the specific requirements.

I claim:

1. In a ski boot comprising;

a shell, at least one quarter connected to said shell, and at least one inner shoe removably accommodated within said shell and said quarter, a heating device comprising;

at least one insole member removably accommodated within said inner shoe, accommodation means rigidly associated with said insole member, at least one resistor incorporated within said insole member, at least one power source accommodated within said accommodation means, conductor means electrically connected to said resistor and to said power source, and control means connected to said conductor means for controlling power supply to said resistor from said power source.

2. A heating device according to claim 1 wherein said insole member removably accommodated within said inner shoe comprises;

at least one insole, and at least one rigid inner sole downwardly associated with said insole, and wherein said at least one resistor is located between said insole and said inner sole.

3. A heating device according to claim 1 wherein said insole member removably accommodated within said inner shoe comprises;

at least one insole, and at least one rigid inner sole downwardly associated with said insole, wherein said accommodation means are rigidly associated with said rigid inner sole.

4. A heating device according to claim 1 wherein insole member removably accommodated within said inner shoe defines a heel region, and wherein said accommodation means comprise;

at least one protrusion rigidly associated with said heel region of said insole member, and at least one chamber defined internally within said protrusion.

5. A heating device according to claim 1, wherein said insole member removably accommodated within said inner shoe comprises;

at least one insole, at least one rigid inner sole downwardly associated with said insole, and at least one heel region defined by said rigid inner sole wherein said accommodation means comprise;

at least one protrusion rigidly associated with said heel region of said insole member, and at least one chamber defined internally within said protrusion, and,wherein said power source is constituted by at least one accumulator housed within said chamber.

6. A heating device according to claim 1, wherein said insole member removably accommodated within said inner shoe comprises;

at least one insole, at least one rigid inner sole downwardly associated with said insole, at least one flap connected to said rigid inner sole, and at least one support member rigidly associated with said control means, wherein said support member is at least temporarily connectable to said flap.

7. A heating device according to claim 1, further comprising at least one support member rigidly associated with said control means, said support member being at least temporarily and releasably connectable to said at least one quarter.

8. A heating device according to claim 1, wherein said power source comprises at least one accumulator, and wherein said control means further comprises recharging means, said recharging means being adapted for permitting recharging of said at least one accumulator.

9. A heating device according to claim 8, wherein said control means further comprises indicator means.

10. A heating device according to claim 1, wherein said insole member removably accommodated within said inner shoe comprises;

at least one insole, at least one rigid inner sole downwardly associated with said insole, at least one flap connected to said rigid inner sole, and at least one support member rigidly associated with said control means, wherein said flap has formed therein at least one opening, and wherein said control means is contained in at least one box-like body, said box-like body having rigidly associated therewith at least one tab, said tab being insertable into said opening for at least temporarily connecting said box-like body and said control means to said flap.

11. In a ski boot comprising;

a shell, at least one quarter connected to said shell, and at least one inner shoe removably accommodated within said shell and said quarter, a heating device comprising;

at least one insole member removably accommodated within said inner shoe, accommodation means rigidly associated with said insole member, at least one resistor incorporated within said insole member, at least one power source accommodated within said accommodation means, conductor means electrically connected to said resistor and to said power source, and control means connected to said conductor means for controlling power supply to said resistor from said power source, wherein said insole member comprises;

at least one insole, and at least one rigid inner sole downwardly associated with said insole, wherein said at least one resistor is located between said insole and said inner sole, and wherein said accommodation means comprise at least one chamber defined internally within said insole member.

12. A heating device according to claim 11, further comprising;

a heel region defined by said inner sole, and at least one protrusion defined at said heel region of said inner sole, wherein said chamber is defined within said protrusion, and wherein said power source comprises at least one accumulator housed within said chamber.

13. A heating device according to claim 11, wherein said insole member removably accommodated within said inner shoe comprises;

at least one flap connected to said rigid inner sole, and at least one support member rigidly associated with said control means, wherein said support member is at least temporarily connectable to said flap.

14. A heating device according to claim 11, further comprising at least one support member rigidly associated with said control means, said support member being at least temporarily connectable to said at least one quarter.

15. A heating device according to claim 11, wherein said power source comprises at least one accumulator, and wherein said control means further comprises recharging means, said recharging means being adapted for permitting recharging of said at least one accumulator.

16. A heating device according to claim 11, wherein said control means further comprises indicator means.

17. A heating device according to claim 13, wherein said insole member removably accommodated within said inner shoe comprises at least one support member, said support member being rigidly associated with said control means, and wherein said flap has formed therein at least one opening, said control means being contained in at least one box-like body, said box-like body having rigidly associated therewith at least one tab, said tab being insertable into said opening for at least temporarily connecting said box-like body and said control means to said flap.

18. In a ski boot comprising;

a shell, at least one quarter connected to said shell, and at least one inner shoe removably accommodated within said shell and said quarter, a heating device comprising;

at least one insole member removably accommodated within said inner shoe, accommodation means rigidly associated with said insole member, at least one resistor incorporated within said insole member, at least one power source accommodated within said accommodation means, conductor means electrically connected to said resistor and to said power source, control means connected to said conductor means for controlling power supply to said resistor from said power source, and at least one flap connected to said insole member, wherein said accommodation means comprise at least one chamber defined internally within said insole member, and wherein said heating device further comprises at least one support member, said support member being rigidly associated with said control means and at least temporarily connectable to at least one element, said at least one element being selected among said flap and said quarter.

19. A heating device according to claim 18, wherein said insole member comprises;

at least one insole, and at least one rigid inner sole downwardly associated with said insole, and wherein said rigid inner sole has rigidly associated therewith at least one protrusion, said at least one chamber being defined in said at least one protrusion.

20. A heating device according to claim 18, wherein said power source is constituted by at least one accumulator, said accumulator being housed within said chamber, and wherein said control means further comprises recharging means, said recharging means being adapted for permitting recharging of said at least one accumulator.

* * * * *